US008231240B1

(12) United States Patent
Rubio et al.

(10) Patent No.: US 8,231,240 B1
(45) Date of Patent: Jul. 31, 2012

(54) SURFACE LIGHTING DEVICES HAVING A THERMOELECTRIC POWER SOURCE

(75) Inventors: Edward Rubio, El Paso, TX (US); Stanley S. Hirsh, El Paso, TX (US); David C. Nemir, El Paso, TX (US)

(73) Assignee: TXL Group, Inc., El Paso, TX (US)

( * ) Notice: Subject to any disclaimer, the term of this patent is extended or adjusted under 35 U.S.C. 154(b) by 774 days.

(21) Appl. No.: 12/333,520

(22) Filed: Dec. 12, 2008

Related U.S. Application Data

(60) Provisional application No. 61/007,319, filed on Dec. 12, 2007.

(51) Int. Cl.
*F21L 13/00* (2006.01)

(52) U.S. Cl. ..... 362/192; 362/153.1; 362/249.02; 362/253; 362/800; 136/203

(58) Field of Classification Search ..... 362/192, 362/153.1, 241, 249.02, 20, 253, 236, 247, 362/800; 136/203, 212, 204, 211
See application file for complete search history.

(56) References Cited

U.S. PATENT DOCUMENTS 3,332,327 A 7/1967 Johnson
3,524,772 A * 8/1970 Purdy ..... 136/212
4,459,428 A * 7/1984 Chou ..... 136/212
4,497,973 A * 2/1985 Heath et al. ..... 136/212
4,668,120 A * 5/1987 Roberts ..... 404/12
4,904,998 A * 2/1990 Niimi ..... 340/908.1
5,680,033 A * 10/1997 Cha ..... 362/153.1
5,782,552 A * 7/1998 Green et al. ..... 362/183
5,839,816 A * 11/1998 Varga et al. ..... 362/153.1
5,984,570 A * 11/1999 Parashar ..... 362/153.1
6,210,017 B1 * 4/2001 Miura et al. ..... 362/153.1
6,602,021 B1 * 8/2003 Kim ..... 404/16
6,789,915 B2 9/2004 Van Der Poel
7,273,328 B2 * 9/2007 Hunter et al. ..... 404/12
7,347,643 B2 3/2008 Jeong
7,794,103 B2 * 9/2010 Hoover ..... 362/153.1
2006/0198149 A1 9/2006 Jonsson

* cited by examiner

*Primary Examiner* — Ismael Negron
(74) *Attorney, Agent, or Firm* — Winstead PC

(57) ABSTRACT

Surface lighting devices including at least one light source, at least one energy storage device, and a thermoelectric power generation unit electrically coupled to the at least one energy storage device are disclosed herein. The at least one energy storage device is charged by the thermoelectric power generation unit, and the stored energy is used to illuminate the at least one light source. The surface lighting devices include a voltage step-up circuit that converts a DC voltage produced by the thermoelectric power generation unit into a higher-level DC voltage. Methods for illuminating a surface utilizing the surface lighting devices are also disclosed.

18 Claims, 7 Drawing Sheets

SURFACE LIGHTING DEVICES HAVING A THERMOELECTRIC POWER SOURCE

CROSS-REFERENCE TO RELATED APPLICATIONS

This application claims the priority of U.S. Provisional Patent Application 61/007,319 filed Dec. 12, 2007, which is incorporated by reference as if written herein in its entirety.

BACKGROUND

Markers are commonly used to demarcate the edges of roadways, parking lots, airport runways and taxiways, sidewalks, stairways and trails. The markers enhance safety by providing a visual assessment of safe boundaries. Markers often incorporate passive reflectors to reflect incident light back to an observer. Observable reflectivity, which pinpoints the marker's position, depends upon a directional incident light beam for reflection. Retroreflective markers for roadway applications typically have an inclined front face at a suitable angle for reflecting incident light and sometimes allowing the front face of the marker to be wiped clean, for example, through contact with vehicle tires. Environmental conditions, such as rain or snow, can impair reflection of an incident light beam. Further, terrain may be such that a incident light beam from, for example, a car or bicycle headlights, does not directly strike the marker's passive reflector. In addition, retroreflective qualities tend to decrease over time due to ultraviolet degradation, moisture creep and cracking.

As an alternative to passive illumination, various markers having an independent light source have been described. Unlike retroreflective markers, lighted markers require some type of power source. The power source may be external, such as, for example, electrical wiring. Internal power sources have also been used. Solar powered markers having one or more photovoltaic cells generate electricity during the day and charge a capacitor or rechargeable battery for use at night. Photovoltaic cells tend to be easily damaged, and their electrical generation is heavily impacted by environmental conditions. For example, on cloudy days or during winter months, there is less daylight available for charging. Further, when photovoltaic cells are scratched or covered with dirt or snow, power generation is hindered.

Pavement markers having a light source powered internally by non-photovoltaic means have been described. For example, certain pavement markers utilizing the conversion of mechanical energy in the form of vibrational energy into electrical energy are known. The vibrational energy is generated when vehicles run on the roadway. As with photovoltaic cells, sufficient power generation is problematic in areas of fluctuating or low traffic in providing continuous overnight power.

In contrast to photovoltaic cells, which harvest incident light to generate electricity, thermoelectric cells generate electricity based on a thermal gradient existing about the thermoelectric cells. For example, a thermal gradient can exist between a pavement surface and the earth surrounding the pavement surface. Thermoelectric generation of electricity takes place with either variation of thermal gradient-electricity generation occurs when one side of the thermoelectric cell is either hotter or colder than its surrounding environment. Since thermoelectric cells do not require direct exposure to sunlight, they can be deployed within a protective housing to prevent damage.

In view of the foregoing, markers not relying solely on passive reflection or an inconsistent power source for illumination are likely to be of considerable benefit. For example, markers having a thermoelectric power generation unit for operating an internal light source would likely have a long useful lifetime and be operable under nearly any variety of surrounding environmental conditions.

SUMMARY

In various embodiments, surface lighting devices are disclosed. The surface lighting devices include at least one light source, at least one energy storage device, and a thermoelectric power generation unit. The thermoelectric power generation unit is electrically coupled to the at least one energy storage device. The at least one energy storage device is charged by the thermoelectric power generation unit. The at least one energy storage device powers the at least one light source.

In other various embodiments, voltage step-up circuits coupled to a thermoelectric power generation unit are disclosed. The voltage step-up circuits include a thermoelectric power generation unit, at least one transformer, at least one junction field effect transistor, at least two diodes, at least two capacitors, and at least two output terminals. The voltage step-up circuits convert a DC voltage from the thermoelectric power generation unit into a higher-level DC voltage.

In still other various embodiments, methods for illuminating a surface are disclosed. The methods include attaching a plurality of lighting devices to a surface. The surface is at a thermal gradient with its surroundings. Each of the lighting devices includes at least one light source, at least one energy storage device, and a thermoelectric power generation unit electrically coupled to the least one energy storage device. The methods also include charging the at least one energy storage device within each of the plurality of lighting devices until the plurality of lighting devices becomes illuminated.

The foregoing has outlined rather broadly various features of the present disclosure in order that the detailed description that follows may be better understood. Additional features and advantages of the disclosure will be described hereinafter, which form the subject of the claims.

BRIEF DESCRIPTION OF THE DRAWINGS

For a more complete understanding of the present disclosure, and the advantages thereof, reference is now made to the following descriptions to be taken in conjunction with the accompanying drawings describing specific embodiments of the disclosure, wherein.

DETAILED DESCRIPTION

Figure 1:
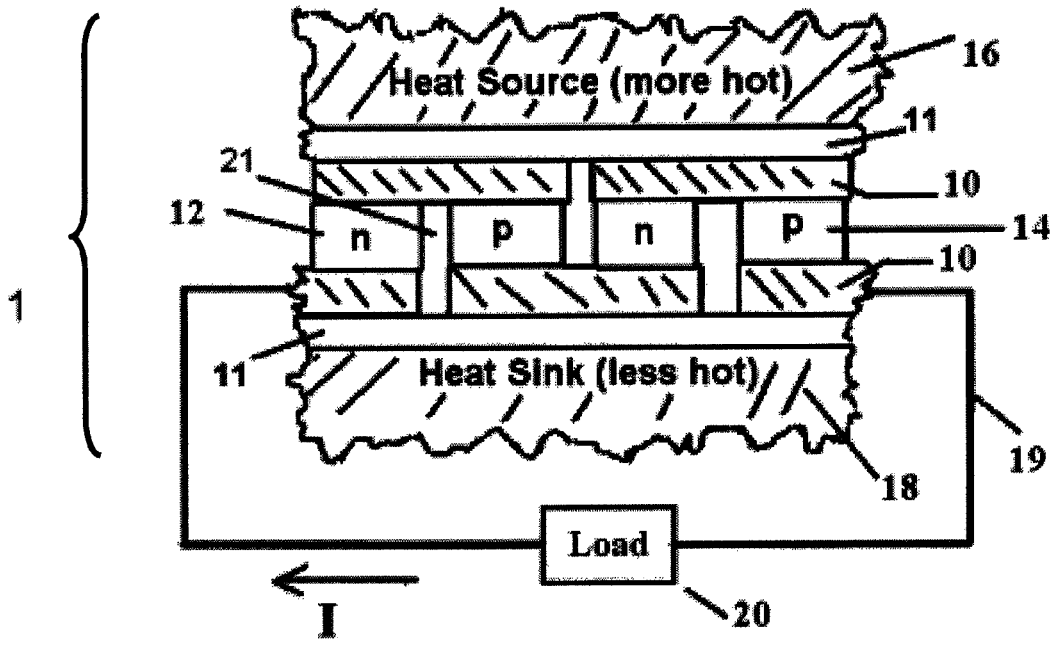
Figure 1 (Prior Art)
FIG. 1 illustrates a side view schematic of an exemplary prior art multi-element thermoelectric generator.

In the following description, certain details are set forth such as specific quantities, sizes, etc. so as to provide a thorough understanding of the various embodiments disclosed herein. However, it will be obvious to those skilled in the art that the present disclosure may be practiced without such specific details. In many cases, details concerning such considerations and the like have been omitted inasmuch as such details are not necessary to obtain a complete understanding of the present disclosure and are within the skills of persons of ordinary skill in the relevant art.

Referring to the drawings in general, it will be understood that the illustrations are for the purpose of describing particular embodiments of the disclosure and are not intended to be limiting thereto. Drawings are not necessarily to scale.

While most of the terms used herein will be recognizable to those of skill in the art, it should be understood, however, that when not explicitly defined, terms should be interpreted as adopting a meaning presently accepted by those of skill in the art.

Various embodiments presented hereinbelow reference surface lighting devices utilizing thermoelectric power generation. A thermoelectric generator transforms heat energy in the form of a temperature gradient into electricity. Surface lighting devices powered by an internal thermoelectric power source possess a number of advantages, such as, for example, in pavement marker applications. First, thermoelectric generators in the surface lighting devices can acquire power from a bidirectional thermal gradient. In other words, the thermoelectric generators of the devices are operational when the surroundings are either hotter or colder than the thermoelectric generators. Second, as a result of the ability of the thermoelectric generators to produce electricity from a bidirectional thermal gradient, the thermoelectric generators are operational on a near-continual basis during the day and the night. Finally, the thermoelectric elements of the thermoelectric generators are quite durable and resistant to mechanical damage.

Thermoelectric generation takes place when a temperature difference (thermal gradient) applied to a conductor or semiconductor causes charge carriers (either electrons or holes) to migrate along the thermal gradient from hot to cold. The resulting separation of charge creates an electric field potential known as the Seebeck voltage ΔV as shown in formula (1), wherein S $$\Delta^{V=S\Delta T} \tag{1}$$

is a temperature- and material-dependent property known as the Seebeck coefficient and ΔT is the temperature difference between the cold side and the hot side. The Seebeck coefficient S for a particular material may be positive or negative depending upon, for example, the type of majority charge carrier.

Two other material parameters that are of interest when analyzing a thermoelectric material include the electrical conductivity, σ, and the thermal conductivity, λ. Energy losses in a thermoelectric material due to Joule ($I^2R$) heating are lower when the electrical conductivity is relatively high. Diffusive heat losses, which arise, for example, due to thermal energy passing through the thermoelectric material without being converted to electricity, are minimized in a material having a low thermal conductivity. The Seebeck coefficient S, electrical conductivity σ, and thermal conductivity λ are often grouped together to establish a single thermoelectric figure of merit Z characterizing a thermoelectric material as shown in formula (2). Z is a function of $$Z = \frac{\sigma S^2}{\lambda} \tag{2}$$

temperature, since the parameters σ, and S are temperature dependent. In a thermoelectric material having uniform cross-sectional area, A, and uniform length, L, electrical and thermal resistances between the hot side and the cold side of the thermoelectric material are calculated as shown in formulas (3) and (4), wherein $R_E$ is the electrical resistance and $R_T$ is the thermal $$R_E = \frac{L}{\sigma A} \tag{3}$$

$$R_E = \frac{L}{\lambda A} \tag{4}$$

resistance. Using formulas (2-4), an alternative expression for the thermoelectric figure of merit Z for a thermoelectric material of uniform composition, cross-sectional area and length can be formulated as presented in formula (5). Higher values of Z provide greater conversion $$Z = \frac{S^2 R_T}{R_E} \tag{5}$$

efficiency in an idealized thermoelectric device. At temperatures in the range of about 250 K to about 400 K, alloys of bismuth-telluride exhibit the highest values of Z currently known.

For real applications of thermoelectric devices, there are other factors to be considered in the conversion of heat energy in the form of a thermal gradient into electrical energy. For example, the amount of power that can be practically generated from a particular heat source/heat sink system will also depend upon the ability of the heat source/heat sink system to deliver/absorb thermal energy to/from the thermoelectric generator. In particular, there may be a thermal interface between the thermoelectric material and the heat source or heat sink. This results in thermal contact resistance, across which there may be a significant temperature drop. As a result of the diminished thermal gradient, reduced power generating capacity results.

The thermoelectric element of a thermoelectric generator is the component where heat in the form of a thermal gradient is converted into electricity. A thermoelectric generator may have one or more than one thermoelectric element for electricity generation. Considerations for choosing the number of thermoelectric elements in a given thermoelectric generator are discussed hereinbelow. Thermoelectric elements may be constructed from several different thermoelectric materials. For example, thermoelectric materials may include metallic conductors, such as, for example, bismuth and antimony. Higher efficiency thermoelectric materials typically include, for example, intrinsic semiconductors, n-doped semiconductors, and p-doped semiconductors. Illustrative non-metalllic thermoelectric materials include, for example, bismuth chalcogenides, skudderite-type materials, and complex oxide materials. Bismuth chalcogenides include, for example, $Bi_2Te_3$ and $Bi_2Se_3$. One may produce n-type and p-type thermoelectric elements by heavy doping of these compositions with selenium and antimony, respectively. Published example stoichiometries for doped $Bi_2Te_3$ n-type and p-type thermoelectric elements are given in *Thermoelectrics Handbook, Macro to Nano*, D. M. Rowe, editor, CRC Press, Boca Raton, Fla., 2006, p. 27-9 as $(Bi_2Te_3)_{95}(Bi_2Se_3)_5$ for n-type elements and $(Bi_2Te_3)_{75}(Sb_2Te_3)_{25}$ for p-type elements. Skudderite-type materials include, for example, cobalt arsenide and materials of the form $MX_3$, wherein M includes, for example, cobalt, nickel and iron, and X includes, for example, phosphorus, antimony, and arsenic. Complex oxide materials include, for example, $(SrTiO3)_n(SrO)_m$, wherein n and m are integer or non-integer values, and $Ca_3Co_4O_9$. Thermoelectric materials can also be formed from low-dimensional constructs such as, for example, quantum dots, nanowires and quantum wells. The low-dimensional thermoelectric materials may include, for example, PbSeTe and doped or undoped silicon nanowires.

Thermoelectric generators are typically formed, for example, by connecting a number of n- and p-type thermoelectric elements electrically in series and thermally in parallel. FIG. 1 presents a side view schematic of prior art multi-element thermoelectric generator 1. The multi-element thermoelectric generator 1 is constructed by sandwiching n-type thermoelectric elements 12 and p-type thermoelectric elements 14 between electrical conductor layers 10. The electrical conductor layers 10 are chosen to be good conductors of both electricity and heat for optimal thermoelectric generation. The n-type thermoelectric elements 12 and p-type thermoelectric elements 14 are separated from one another by electrical insulator 21. In many embodiments, electrical insulator 21 may simply be a small air or vacuum gap between the n-type thermoelectric elements 12 and the p-type thermoelectric elements 14. Physical separation between the n-type thermoelectric elements 12 and the p-type thermoelectric elements 14 impedes the transfer of charge carriers between the two. In some embodiments, electrical insulator 21 may comprise an insulating material, such as, for example, a silica aerogel or an organic electrical insulator. Illustrative organic electrical insulators include, for example, polymers, which generally have poor heat transfer properties. An illustrative polymer includes, for example, polyethylene. Optional electrical insulator layers 11 provide mechanical support to hold electrical conductor layers 10 in place. The optional electrical insulator layers 11 are constructed from a material that is a good electrical insulator and a good thermal conductor such as, for example, aluminum oxide.

When the multi-element thermoelectric generator 1 is placed between a heat source 16 and a heat sink 18, there is a flow of heat energy from heat source 16 to heat sink 18. As heat flows from heat source 16 to heat sink 18, the charge carriers (electrons for n-type thermoelectric elements 12 and holes for p-type thermoelectric elements 14) move in the direction of heat flow. Movement of charge carriers results in an electrical current, I, which moves through circuit 19 to attached electrical load 20.

Devices may be prepared that utilize thermoelectric generation as a power source. In various embodiments described hereinbelow, surface lighting devices are disclosed. The surface lighting devices include at least one light source, at least one energy storage device, and a thermoelectric power generation unit electrically coupled to the at least one energy storage device. The at least one energy storage device is charged by the thermoelectric power generation unit. The at least one energy storage device powers the at least one light source.

Although various light sources may be used in the surface lighting devices, light-emitting diodes (LEDs) are particularly advantageous in applications where the surface lighting devices are installed and left unattended, such as, for example, pavement markers. Advantages of LEDs include their long lifetime and shock resistance. In various embodiments of the surface lighting devices, the at least one light source comprises at least one light-emitting diode. LEDs are well known in the art and can be prepared in a variety of colors spanning the visible region of the electromagnetic spectrum. The LEDs in the surface lighting devices may be continuously lit, or operation of the LEDs may be triggered by an input such as that obtained, for example, from a photosensor. In a low lighting condition, such as for example, the period from dusk until dawn, the LEDs may remain lit. The LEDS may also be triggered by a timer, for example. The LEDs in the surface lighting devices may also be dimmed in response varying light conditions, rather than being turned off entirely. The LEDs of the surface lighting devices also may blink.

In various embodiments of the surface lighting devices, the at least one energy storage device comprises at least rechargeable one battery. In other various embodiments of the surface lighting devices, the at least one energy storage device comprises at least one capacitor. In addition to surface lighting devices powered by rechargeable batteries or capacitors, in some embodiments, the surface lighting devices further comprise at least one reflective surface. Having at least one reflective surface conveys an added safety feature to the surface lighting devices in the event of failure of the primary light source.

In various embodiments of the surface lighting devices, the thermoelectric power generation unit comprises a plurality of thermoelectric elements. Each of the thermoelectric elements is connected electrically in series and thermally in parallel. The present disclosure utilizes heat flow along a thermal gradient existing between two sides of a thermoelectric power generation unit to power the surface lighting devices. The direction of the thermal gradient is not particularly important, as thermoelectric power generation can occur for both positive and negative thermal gradients.

Various factors account for establishing a thermal gradient, such as, for example, when the surface lighting devices are used in pavement marker applications. Asphalt, dirt, gravel, cement and other paving materials have relatively large heat capacities and do not rapidly change temperature. In subsurface locations of the pavement, temperature is fairly stable. The deeper one proceeds into the subsurface, the less variation is observed with time. In contrast, the pavement surface heats rapidly due to the warming effect of the sun's rays during the day and cools rapidly through radiative effects during the night. The surface temperature is also affected by factors such as, for example, ambient air temperature, precipitation, or wind. By configuring a thermoelectric power generation unit within a surface lighting device such that one side of the thermoelectric power generation unit is subsurface or in thermal contact with the subsurface and the opposite side of the thermoelectric power generation unit is above the surface or in thermal contact with the surface, a significant temperature gradient may be maintained for the majority of any 24 hour period. As such, this feature advantageously allows thermoelectric power generation to take place during both day and night.

Figure 2:
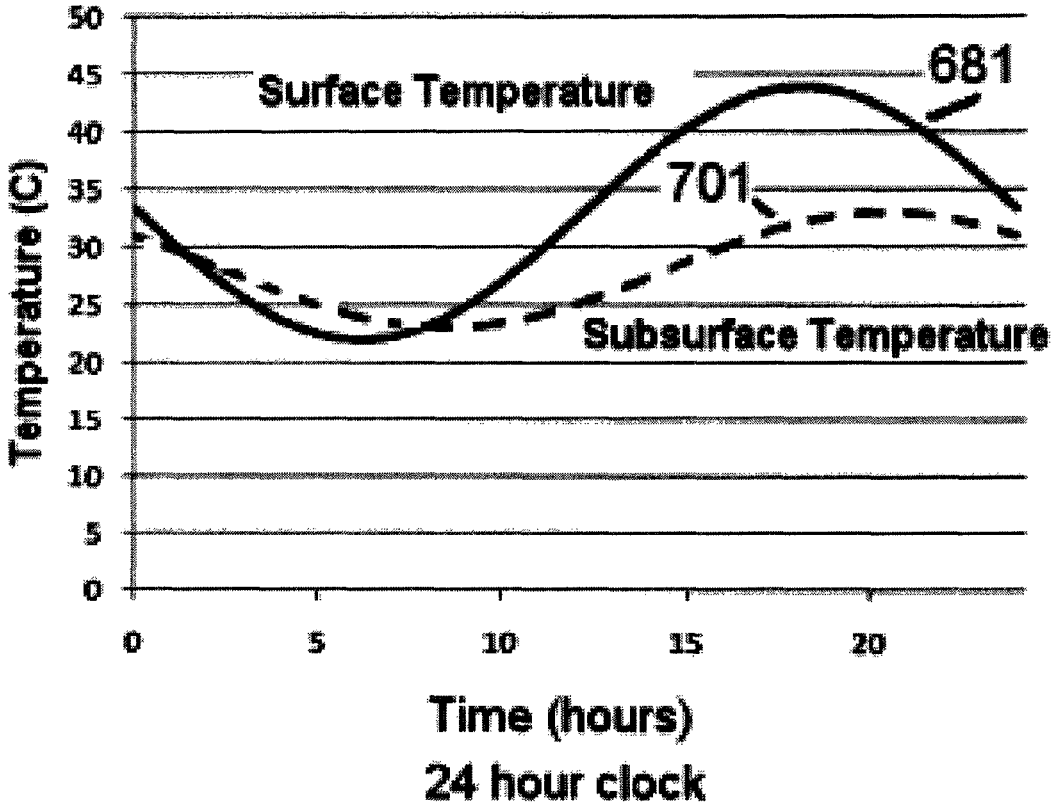
FIG. 2 presents an illustrative profile of summertime roadway surface temperatures and roadway subsurface temperatures as a function of time.

FIG. 2 presents an illustrative profile of summertime roadway surface temperatures and roadway subsurface temperatures as a function of time. The surface temperature trace 681 has a cyclical profile over a 24 hour period starting at midnight. The lowest temperature for the surface temperature trace 681 occurs at about 6:30 AM after cooling all night. Beginning about 6:30 AM, solar heating raises the pavement temperature until a peak temperature is reached at about 4:00 PM. The subsurface temperature trace 701 shows less variation from maximum to minimum due to the heat capacity of the pavement/earth/concrete and other subsurface materials, as well as other factors discussed hereinabove. The maximum and minimum of the subsurface temperature trace 701 are shifted somewhat from the maximum and minimum of the surface temperature trace 681. The temperature difference between surface temperature trace 681 and subsurface temperature trace 701 forms the thermal gradient that drives heat flow through a thermoelectric power generation unit and results in electricity production. As long as the thermal gradient is nonzero, electricity is generated by the thermoelectric power generation unit. By examining the difference in surface temperature trace 681 and subsurface temperature trace 701, one can see that peak gradients (and hence peak generating time) occur approximately between the hours of noon to 8 PM. Electricity generation can occur at most times during the day and during the night. Only at the two points where surface temperature trace 681 and subsurface temperature trace 701 intersect is there no gradient available for electricity generation.

Figure 3:
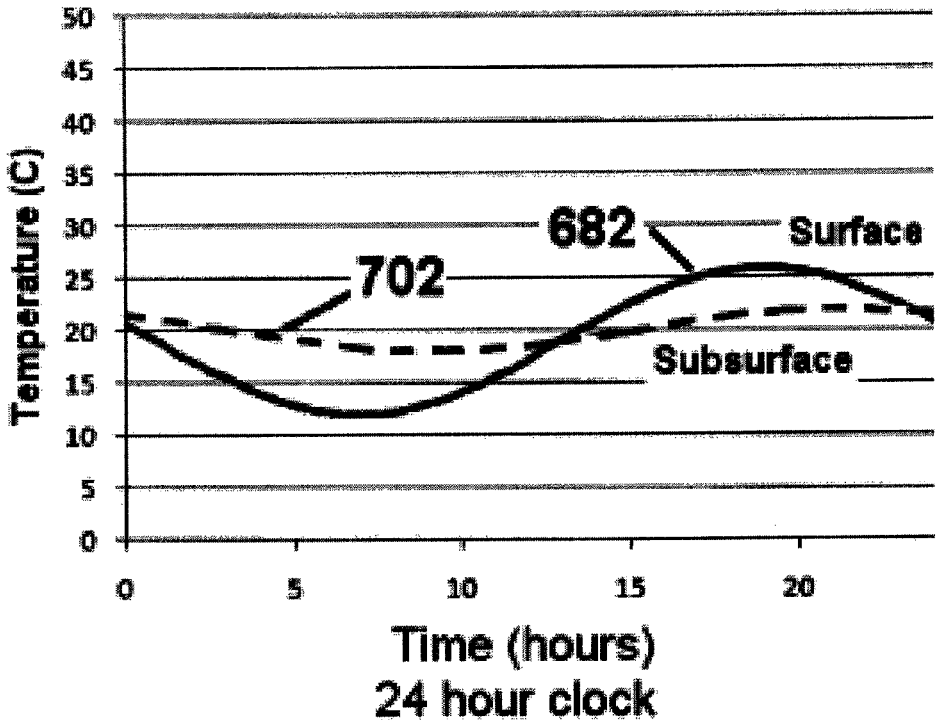
FIG. 3 presents an illustrative profile of wintertime roadway surface temperatures and roadway subsurface temperatures as a function of time.

FIG. 3 presents an illustrative profile of wintertime roadway surface temperatures and roadway subsurface temperatures as a function of time. Like the summertime profile shown in FIG. 2, the subsurface temperature trace 702 shows a slight time lag in maximum and minimum from the surface temperature trace 682. Further, the change in temperature for the subsurface over the course of 24 hours is less dramatic than the change in surface temperature. Wintertime peak thermal gradients between subsurface temperature trace 702 and surface temperature trace 682 occur approximately between the hours of 1 AM to 10 AM. Significant thermal gradients and thermoelectric generation potential also occur approximately between the hours of 3 PM to 8 PM.

In various embodiments of the surface lighting devices disclosed hereinabove, the surface lighting devices further include a thermally-insulating base plate and a thermally-conducting stud. Such features of the surface lighting devices are beneficial in establishing a temperature gradient in the surface lighting devices, as will be discussed hereinbelow. In various embodiments of the surface lighting devices, the thermally-insulating base plate includes at least one polymer and the thermally-conducting stud includes at least one metal. Polymers are typically poor thermal conductors, and metals are typically good thermal conductors. In various embodiments of the surface lighting devices, the surface lighting devices further include a metal housing having an exterior surface and an interior surface. In various embodiments of the surface lighting devices, the thermoelectric power generation unit contacts the thermally-conducting stud. In various embodiments of the surface lighting devices, at least a portion of the interior surface of the metal housing contacts the thermoelectric power generation unit.

Placement of the surface lighting devices may be partially above grade or completely below grade. In various embodiments of the surface lighting devices, at least a portion of the surface lighting device is above a surface to which the device is attached. In other various embodiments of the surface lighting devices, the surface lighting device resides below a surface to which the device is attached. Applications where the devices are at least partially raised above a surface include, for example, pavement lighting applications where visibility is a primary concern. In other applications, such as, for example, applications where the surface lighting devices are used to illuminate a sidewalk or pedestrian trail, a recessed device at grade or below the surface may be more advantageous to prevent tripping and potential injury to pedestrians.

Figure 4:
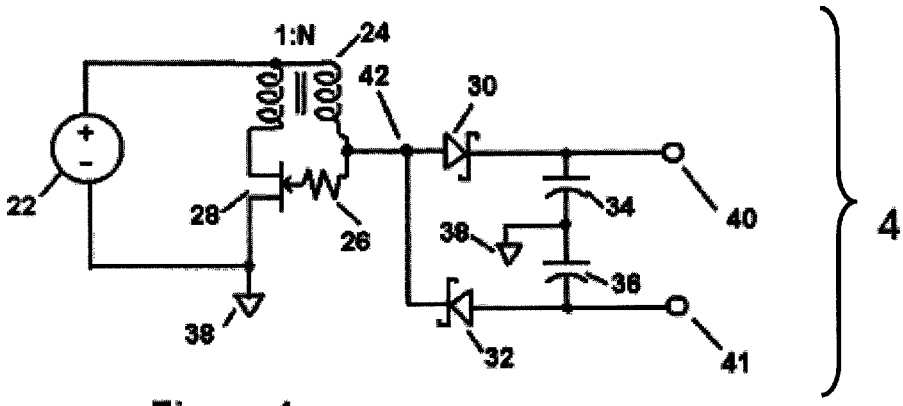
FIG. 4 presents a schematic of an illustrative electronic voltage step-up circuit that transforms a low DC voltage produced by a thermoelectric power generation unit into a higher DC voltage.

FIG. 4 presents a schematic of an illustrative electronic voltage step-up circuit that transforms a low-level DC voltage produced by a thermoelectric generator into a higher-level DC voltage. The step-up voltage generated can thereafter charge a capacitor or rechargeable battery. Such circuitry and variations thereof can be embedded in the surface lighting devices disclosed herein. Voltage step-up circuit 4 includes thermoelectric power generation unit 22. An illustrative thermoelectric power generation unit 22 has been discussed hereinabove and is depicted in FIG. 1. For example, an illustrative thermoelectric power generation unit 22 includes equal numbers, M, of n-type and p-type thermoelectric elements that are connected electrically in series and thermally in parallel. In such an illustrative thermoelectric power generation unit 22, the generated DC voltage is given by formula (6), wherein $S_n$ and $S_p$ are the $$V=M(S_n+S_p)\Delta T \tag{6}$$

Seebeck coefficients for the n-type and p-type thermoelectric materials, respectively, that are used in the thermoelectric power generation unit 22. One skilled in the art will recognize the utility of having multiple thermoelectric elements, given that the temperature difference ΔT may be relatively small in a number of applications. However, increased voltage generation is offset by increased internal resistance resulting from multiple thermoelectric elements. Further, having multiple thermoelectric elements impacts the size of the thermoelectric power generation unit 22 and devices into which the thermoelectric power generation unit 22 is incorporated. Thermoelectric power generation units having any number of thermoelectric elements reside within the spirit and scope of the disclosure herein.

Given resistance and size constraints imposed by having multiple thermoelectric elements in excess of an optimal number, use of a voltage step-up circuit, such as that illustrated in FIG. 4 is advantageous. The low-level voltage produced by thermoelectric power generation unit 22 is converted into a higher voltage by transformer 24. Transformer 24 has any value of the turns ratio which is suitable for upwardly converting the voltage produced by thermoelectric power generation unit 22. For example, an illustrative transformer 24 has a turns ratio of about 1:25. An n-type depletion mode junction field effect transistor (JFET) 28 serves to control circuit oscillations. The n-type depletion mode JFET 28 is advantageous in the applications described herein, since it is initially conducting with zero gate voltage. Noise anywhere in the circuit causes small positive and negative voltage excursions in the gate of n-type depletion mode JFET 28, causing modulation of the conductivity. Circuit noise arises, for example, from thermal excitation in the n-type depletion mode JFET 28 or transformer 24 which is coupled into external electromagnetic energy sources (i.e., cell phones, power lines and other sources). Circuit noise produces a change in current flow into the primary side of transformer 24. The change in current flow in the primary side of transformer 24 is coupled to the secondary side of transformer 24 to increase the modulation of n-type depletion mode JFET 28 current. As n-type depletion mode JFET 28 is alternately turned on and then off, a feedback loop is created, which ultimately results in an oscillating AC voltage at node 42. The AC voltage at node 42 is higher than the DC voltage produced by the thermoelectric power generation unit 22. As shown in FIG. 4, n-type depletion mode JFET 28 is depicted as a single electronic component. One skilled in the art will recognize that multiple JFETs can be connected in parallel, while still operating within the spirit and scope of the disclosure. Similarly, one skilled in the art will recognize that n-type depletion mode JFET 28 can be replaced with a single p-type depletion mode JFET or multiple p-type depletion mode JFETs connected in parallel. When a p-type depletion mode JFET is used, the polarity of the thermoelectric power generation unit 22 is reversed in voltage step-up circuit 4.

Referring still to FIG. 4, diodes 30 and 32, together with capacitors 34 and 36, rectify the AC voltage at node 42 to produce a "doubled" DC-rectified voltage at output terminals 40 and 41. Any type of diode known in the art may be used in voltage step-up circuit 4. Use of Shottky-type diodes for diodes 30 and 32 provides particular benefits due to the relatively low forward voltage drop offered by these diodes. Resistor 26 provides some isolation between the gate of n-type depletion mode JFET 28 and node 42. In some applications, resistor 26 could be replaced an electrical short (resistance equals zero ohms). Circuit commons 38 denote points of equivalent voltage potential, which are obtained by making an electrical connection (short) between such points.

Diodes 30 and 32 and capacitors 34 and 36 comprise features of the voltage step-up circuit 4 described hereinabove. It will be evident to one skilled in the art, however, that one diode and one capacitor can also be used to accomplish the voltage rectification. For example, a minimum implementation of the voltage step-up circuit can be constructed by eliminating diode 32 by open circuiting (removing) diode 32 and by replacing capacitor 36 with a short circuit.

Figure 5:
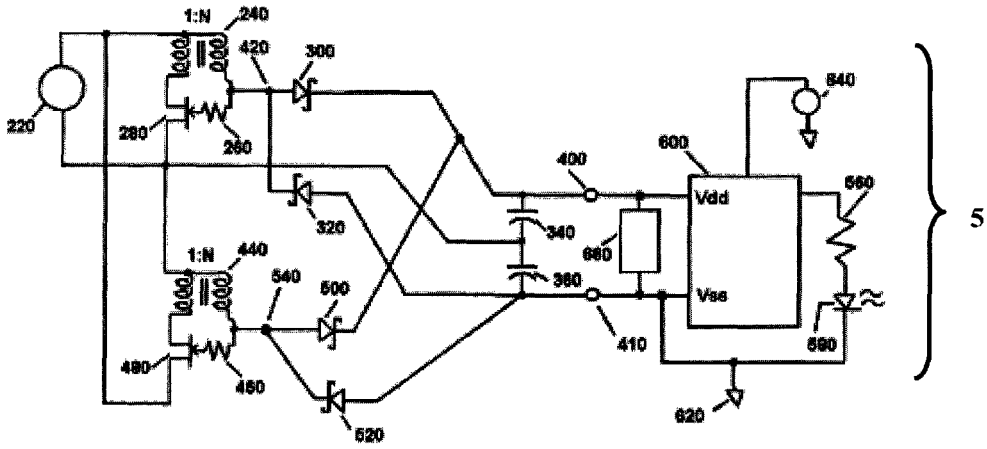
FIG. 5 presents a schematic of an illustrative electronic circuit having a thermoelectric power generation unit operable with either a cold-hot or hot-cold polarity of thermal gradient.

A schematic of an illustrative electronic circuit having a thermoelectric power generation unit operable with either a cold-hot or hot-cold polarity of temperature gradient is shown in FIG. 5. The power generated by the thermoelectric power generation unit is used to charge a rechargeable battery or capacitor. The electronic circuit 5 presented in FIG. 5 is advantageous, since polarity of the thermoelectric power generation unit 220 is not a factor in operation of the electronic circuit 5. As such, polarity of the thermoelectric power generation unit 220 has not been indicated in FIG. 5. Voltage step-up is provided by either transformer 240 or 440. If the thermoelectric power generation unit 220 polarity is as shown in FIG. 4, then JFET 280 in FIG. 5 is active. The on/off activity of JFET 280 results in an AC voltage at node 420. If JFET 280 is active due to the polarity of thermoelectric power generation unit 220, then JFET 480 is not active and there is no AC voltage at node 540. With a reversal of polarity in the thermoelectric power generation unit 220, JFET 480 oscillates, resulting in an AC voltage at node 540. The reversal of polarity causes JFET 280 to become inactive. Resistors 260 and 460 provide some isolation between the gates of JFETs 280 and 480 and nodes 420 and 540. As discussed above concerning FIG. 4, either diodes 300 and 320 or diodes 500 and 520 operate together with capacitors 340 and 360 to rectify the AC voltage into a DC voltage. Output terminals 400 and 410 connect to capacitor 660, which stores the accumulated energy. One skilled in the art will recognize that capacitor 660 may be substituted with a rechargeable battery.

Referring still to FIG. 5, the accumulated energy in capacitor 660 is used to power microcontroller 600. Microcontroller 600 periodically tests the ambient light levels through sampling conducted by photosensor 640. In a pavement marker application, photosensor 640 is oriented to give an indication of daytime or nighttime. If microcontroller 600 senses a daytime condition, light-emitting diode 580 is turned off, and the electronic circuit 5 enters a low power mode for a set period of time to conserve energy. After a set period of dormancy, microcontroller 600 becomes active again and retests ambient light levels using photosensor 640. If microcontroller 600 detects a low ambient light condition, light emitting diode 580 is turned on, thereby illuminating the pavement marker. Although FIG. 5 depicts a single light-emitting diode 580, multiple multiple light emitting diodes may be controlled by the microcontroller 600. When the light-emitting diode 580 is on, operation can be continuous, or the light-emitting diode 580 may be controlled to blink with an arbitrary frequency and duty cycle. Light-emitting diode 580 is turned off when microcontroller 600 determines that a low ambient light condition no longer exists. The ON/OFF duty cycle of the light-emitting diode 580 can be controlled in response to detected ambient light levels or capacitor 660 charge level. For example, if capacitor 660 is detected by microcontroller 600 to be at a low charge level, the light-emitting diode 580 ON/OFF duty cycle can be controlled to be off more than on in order to extend operational life. Resistor 560 serves to limit the power delivered to light-emitting diode 580.

In various embodiments of the surface lighting devices disclosed herein, the surface lighting devices further include a voltage step-up circuit, such as those disclosed hereinabove. The thermoelectric power generation unit is connected to the voltage step-up circuit. In various embodiments of the surface lighting devices, the voltage step-up circuit includes at least one transformer, at least one junction field effect transistor, at least two diodes, at least two capacitors, and at least two output terminals. The voltage step up circuit may be configured to utilize a fixed polarity of the thermoelectric power generation unit or configured with two circuits in parallel to utilize a non-fixed polarity of the thermoelectric power generation unit. In various embodiments of the surface lighting devices, the at least two output terminals are connected to at least one energy storage device. The energy storage device includes, for example, rechargeable batteries and capacitors. In various embodiments of the surface lighting devices, the voltage step-up circuit further includes a microcontroller. The microcontroller regulates various operational functions of the surface lighting devices, such as, for example, operation of the at least one light source of the surface lighting devices. In various embodiments of the surface lighting devices, the voltage step-up circuit further comprises a photosensor.

Voltage step-up circuits are not limited to use in surface lighting devices. For example, such circuits may be used in any application where electricity can be generated from a latent thermal gradient using a thermoelectric power generation unit. In various embodiments, voltage step-up circuits comprise a thermoelectric power generation unit, at least one transformer, at least one junction field effect transistor, at least two diodes, at least two capacitors, and at least two output terminals. The voltage step-up circuits convert a DC voltage produced by the thermoelectric power generation unit into a higher-level DC voltage. The voltage step-up circuits advantageously permit low voltages generated by small thermal gradients at the thermoelectric power generation unit to be converted into useful voltages such as, for example, for charging an energy storage device. In various embodiments, the voltage step-up circuits further include an energy storage device connected to the at least two output terminals. The energy storage device includes, for example, rechargeable batteries and capacitors. In various embodiments, the DC voltage from the thermoelectric power generation unit is not more than about 40 mV, and the higher-level DC voltage is at least about 1.4 V.

Figure 6:
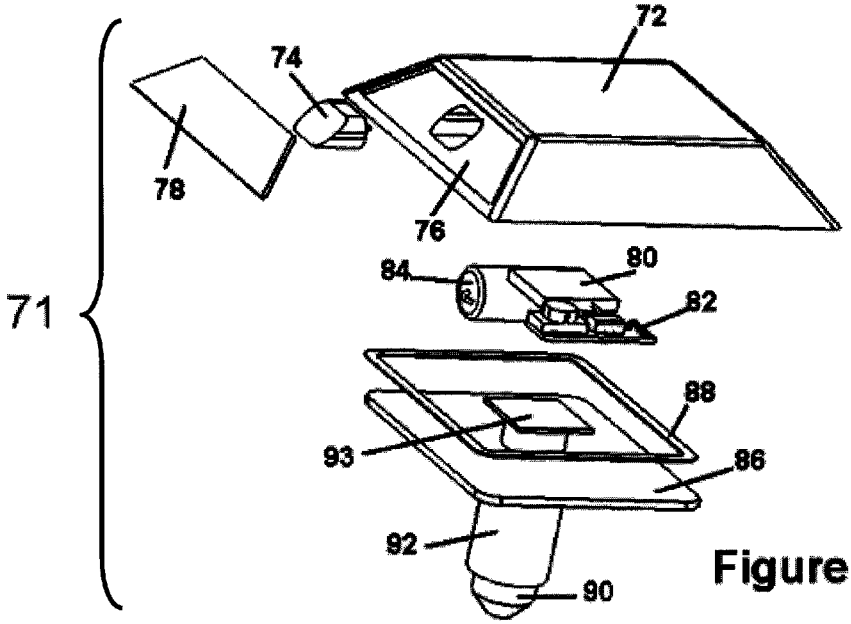
FIG. 6 presents a top view of an illustrative embodiment of a lighted pavement marker powered by a thermoelectric power generation unit.

Further details concerning lighted surface markers powered by a thermoelectric power generation unit are shown in FIG. 6, where a top view of an illustrative embodiment of lighted pavement marker 71 is presented. Marker top 72 is a cast metal housing that provides good mechanical support and protection for thermoelectric power generation unit 80. LED module 74 includes one or more light emitting diodes (LEDs). LED module 74 is oriented at an angle to provide good visibility for a viewer. For example, when lighted pavement marker 71 is mounted to a pavement surface, the inclination angle for the LED module 74 is about 15 degrees from horizontal in some embodiments. Inclination angle, as used herein, refers to an angle made between the pavement surface (horizontal) and a line drawn normal to a side of the lighted pavement marker 71 in which LED module 74 is installed. In some embodiments, the inclination angle is about 0 degrees from horizontal, in some embodiments about 5 degrees, in some embodiments about 10 degrees, in some embodiments about 15 degrees, in some embodiments about 20 degrees, in some embodiments about 25 degrees and in some embodiments about 30 degrees. Reflective surface 76 is incorporated into lighted pavement marker 71 as an added safety feature. Lens cover 78 protects LED module 74 and reflective surface 76 from dirt, abrasion and moisture. An ultraviolet block can be incorporated into lens cover 78 to extend life of reflective surface 76 through inhibition of photodegradation.

Referring still to FIG. 6, thermoelectric power generation unit 80 powers the LED module 74. The thermoelectric power generation unit 80 is fabricated from a connection of thermoelectric elements in electrical series as discussed hereinabove. Voltage conversion and control circuit 82 steps up a relatively low DC voltage produced by thermoelectric power generation unit 80 into an AC voltage useable for charging energy storage device 84. Energy storage device 84 may comprise one or more rechargeable batteries or one or more capacitors. Insulating base plate 86 includes a material having relatively poor thermal conductivity. An illustrative insulating base plate 86 is formed from a polymer such as, for example, acrylic polymers, polyethylene or other like materials offering durability and relatively poor thermal conductivity. Thermally-conducting stud 90 extends downward for insertion into a roadway at a nominal depth of at least about three inches. In various embodiments, thermally-conducting stud 90 is metallic. Thermally-conducting stud 90 serves two purposes. First, thermally-conducting stud 90 secures lighted pavement marker 71 to the roadway surface. Second, thermally-conducting stud 90 thermally channels subsurface heat to the thermoelectric power generation unit 80. Thermally-conducting stud 90 is topped by boss 93, which conforms to the bottom side of the thermoelectric power generation unit 80. Thermal contact between the bottom of thermoelectric power generation unit 80 and boss 93 can be improved by plating a wetting solution such as, for example, silicone heat grease, between the thermoelectric power generation unit 80 and boss 93 to reduce thermal resistance between the two structures. Insulating sleeve 92 is a thermally insulating sheaf that is attached to, or is part of the insulating base plate 86. Insulating sleeve 92 inhibits heat transfer to and from pavement layers near the surface, thus allowing thermally-conducting stud 90 to communicate temperature at the base of stud 90 to boss 93 without excessive heat energy leakage to upper pavement layers. The insulating base plate 86 and attached insulating sleeve 92 can be constructed of the same thermally insulating material and fabricated as a unitary piece. Alternately, the insulating base plate 86 and insulating sleeve 92 can be fabricated separately. Gasket 88 seals the interior of the lighted pavement marker 71 and prevents moisture intrusion. Gasket 88 is constructed from a pliable material, which forms a deformable interface between marker top 72 and insulating base plate 86. Illustrative materials for constructing gasket 88 are well known in the art and include, for example, butyl rubbers and silicone polymers.

Figure 7:
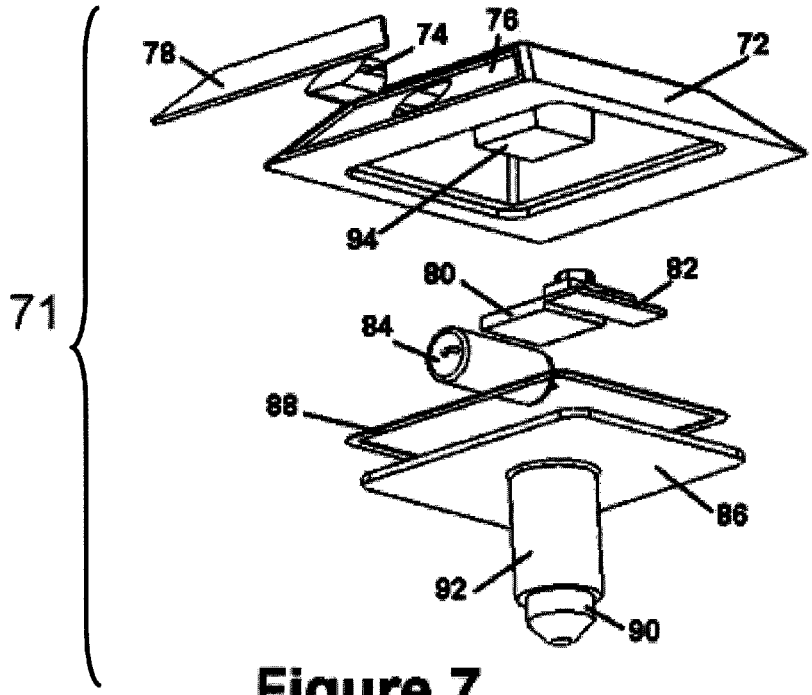
FIG. 7 presents a bottom view of an illustrative embodiment of a lighted pavement marker powered by a thermoelectric power generation unit.

Referring to FIG. 7, a bottom view is shown of the same illustrative embodiment of lighted pavement marker 71 presented in FIG. 6. Viewed from below, boss 94 attachment to marker top 72 is visible. Boss 94 makes thermal contact with the top of the thermoelectric power generation unit 80. Thermal contact between boss 94 and the top of thermoelectric power generation unit 80 can be improved by plating a wetting solution such as, for example, silicone heat grease, between the thermoelectric power generation unit 80 and boss 94 to reduce thermal resistance between the two structures. In the embodiment depicted in FIGS. 6 and 7, one skilled in the art will recognize that the top of the thermoelectric power generation unit 80 will assume a temperature approximately equal to that of marker top 72, and the bottom of thermoelectric power generation unit 80 will assume a temperature which is captured from the area penetrated by thermally-conducting stud 90. When marker top 72 is heated by the sun, it attains a temperature significantly higher than the surrounding ambient air temperature, and this temperature is different from that communicated by thermally-conducting stud 90. As such, the thermoelectric power generation unit 80 is exposed to a temperature gradient suitable for powering the LED module 74.

The surface lighting devices disclosed herein may be used to illuminate a surface. In various embodiments, methods for illuminating a surface are disclosed. The methods include attaching a plurality of lighting devices to a surface. The surface is at a thermal gradient with its surroundings. Each of the lighting devices includes at least one light source, at least one energy storage device, and a thermoelectric power generation unit electrically coupled to the least one energy storage device. The methods also include charging the at least one energy storage device within each of the plurality of lighting devices until the plurality of lighting devices becomes illuminated. In various embodiments of the methods, surfaces illuminated include, for example, roadways, airport runways, airport taxiways, sidewalks, and stairs.

In various embodiments of the methods, at least a portion of the plurality of lighting devices flashes. In various embodiments of the methods, at least a portion of the plurality of lighting devices are continuously illuminated. In various embodiments of the methods, the lighting devices are operated in response to photosensor input. For example, when low ambient lighting is detected by the photosensor, the lighting devices are turned on, and when low ambient lighting is no longer detected, the lighting devices are turned off. In various embodiments of the methods, the plurality of lighting devices are oriented into shape on the surface to which plurality of lighting devices are attached. In various embodiments of the methods, the shape includes a directional signal and a warning signal. A directional signal in a roadway application might include, for example, an arrow indicating an upcoming merge. A warning signal might include, for example, a flashing 'X' indicating a lane closure or other hazard condition.

From the foregoing description, one skilled in the art can easily ascertain the essential characteristics of this disclosure, and without departing from the spirit and scope thereof, can make various changes and modifications to adapt the disclosure to various usages and conditions. The embodiments described hereinabove are meant to be illustrative only and should not be taken as limiting of the scope of the disclosure, which is defined in the following claims.

What is claimed is:

1. A surface lighting device comprising:

at least one light source;

at least one energy storage device;

a thermoelectric power generation unit electrically coupled to the at least one energy storage device;

wherein the at least one energy storage device is charged by the thermoelectric power generation unit; and wherein the at least one energy storage device powers the at least one light source;

a thermally-insulating base plate positioned below the thermoelectric power generation unit; and a thermally-conducting member in thermal connection with the thermoelectric power generation unit.

2. The surface lighting device of claim 1, wherein the at least one light source comprises at least one light-emitting diode.

3. The surface lighting device of claim 1, wherein the at least one energy storage device comprises at least one rechargeable battery.

4. The surface lighting device of claim 1, wherein the at least one energy storage device comprises at least one capacitor.

5. The surface lighting device of claim 1, further comprising:

at least one reflective surface.

6. The surface lighting device of claim 1, wherein the thermally-insulating base plate comprises at least one polymer and the thermally-conducting member comprises at least one metal.

7. The surface lighting device of claim 1, wherein the thermoelectric power generation unit contacts the thermally-conducting member.

8. The surface lighting device of claim 1, further comprising a metal housing having an exterior surface and an interior surface.

9. The surface lighting device of claim 8, wherein at least a portion of the interior surface contacts the thermoelectric power generation unit.

10. The surface lighting device of claim 1, further comprising a voltage step-up circuit; and wherein the thermoelectric power generation unit is connected to the voltage step-up circuit.

11. The surface lighting device of claim 10, wherein the voltage step-up circuit comprises:

at least one transformer;

at least one junction field effect transistor;

at least two diodes;

at least two capacitors; and at least two output terminals.

12. The surface lighting device of claim 11, wherein the at least two output terminals are connected to the at least one energy storage device; and wherein the at least one energy storage device is selected from the group consisting of rechargeable batteries and capacitors.

13. The surface lighting device of claim 11, wherein the voltage step-up circuit further comprises a microcontroller.

14. The surface lighting device of claim 13, wherein the voltage step-up circuit further comprises a photosensor.

15. A method for illuminating a surface, wherein the method comprises:

attaching one or more lighting devices to the surface;

wherein each of the lighting devices comprises:

at least one light source;

at least one energy storage device;

a thermoelectric power generation unit electrically coupled to the at least one energy storage device;

a thermally-insulating base positioned below the thermoelectric power generation unit; and a thermally-conducting member in thermal connection with the thermoelectric power generation unit; and wherein the surface is at a thermal gradient with its surroundings; and charging the at least one energy storage device within each of the lighting devices with the thermoelectric power generation unit; and powering each of the at least one light with the at least one energy storage device.

16. The method of claim 15, wherein the surface is selected from the group consisting of roadways, airport runways, airport taxiways, sidewalks, and stairs.

17. The method of claim 15, wherein at least a portion of the lighting devices flashes.

18. The method of claim 15, wherein the lighting devices are oriented into a shape.

* * * * *